US005603191A

United States Patent [19]

Wu

[11] Patent Number: 5,603,191

[45] Date of Patent: Feb. 18, 1997

[54] PLASTIC DOOR FRAME AND METHOD OF MOUNTING THE SAME

[76] Inventor: Ming-Hsin Wu, 20, Lane 92, Shing Ell Street, Tao Yuan City, Tao Yuan County, Taiwan

[21] Appl. No.: 503,495

[22] Filed: Jul. 18, 1995

[51] Int. Cl.[6] ..... E06B 1/04

[52] U.S. Cl. ..... 52/204.1; 52/211; 52/213; 52/217; 49/504

[58] Field of Search ..... 52/204.1, 211, 52/213, 217; 49/504, 467, DIG. 2

[56] References Cited

U.S. PATENT DOCUMENTS

| | | | |
|---|---|---|---|
| 2,316,425 | 4/1943 | Hosenburger et al. | 49/504 |
| 3,552,085 | 1/1971 | Woodrum | 52/211 |
| 3,721,055 | 3/1973 | Jerchower | 52/217 |
| 4,226,066 | 10/1980 | Persson | 52/211 |
| 4,281,480 | 8/1981 | Wendt | 52/211 X |
| 4,698,944 | 10/1987 | Wilkins, Jr. | 52/217 X |
| 5,345,722 | 9/1994 | McKann | 52/217 |

FOREIGN PATENT DOCUMENTS

| | | | |
|---|---|---|---|
| 1805629 | 9/1969 | Germany | 52/217 |

*Primary Examiner*—Carl D. Friedman
*Assistant Examiner*—W. Glenn Edwards
*Attorney, Agent, or Firm*—Bacon & Thomas

[57] ABSTRACT

A plastic door frame structure and a method of mounting the same after a threshold is installed in a door hole including fixing a packing rail on a wall of the door hole, fitting an outer rail on the packing rail and adjusting the horizontal or vertical position of the outer rail, arranging a link rail at either lateral side of the outer rail such that the link rail conceals a clearance formed between the outer rail and the wall and passing screws through the link rail and the outer rail into the packing rail to keep the outer rail firmly in place, and fitting a seal strip onto the link rail to accomplish an integral plastic door frame, which is cut at 45 degrees at appropriate positions to obtain an inverted-U shaped door frame with the lateral sides perpendicular to the top side.

4 Claims, 4 Drawing Sheets

PLASTIC DOOR FRAME AND METHOD OF MOUNTING THE SAME

BACKGROUND OF THE INVENTION

1. Field of the Invention

The present invention relates to a plastic door frame and a method of mounting the same, and more particularly to a door frame structure which may be easily assembled and mounted on the wall after installation of a threshold.

2. Description of the Prior Art

As a general rule, before mounting a door frame, which may be made of plastics, aluminum or wood, a door hole is formed at a .selected position of the wall. Metal sheets or plates (also known as hook clamps) are embedded at the rear side of the door frame to secure it to the wall. As for the conventional method of mounting the door frame, it essentially consists of providing a door hole in the wall, fitting an inverted-U shaped door frame provided with metal sheets or plates in the door hole and securing the door frame to the wall by means of the metal sheets or plates, and laying a threshold after the door frame is fitted in place. In the conventional method, the concrete used to lay the threshold after the door frame is mounted may stain the door frame and it is troublesome to clean up. Besides, there are usually gaps or clearances formed between the door frame and the wall which need to be filled up with concrete. Undue filling work may cause pressure on the door frame which may tend to deform in shape, and is hence unable to match a door to be hinged thereon.

SUMMARY OF THE INVENTION

A primary object of the present invention is to provide a plastic door frame and a method of mounting the same, in which a threshold is laid at the bottom of a door hole formed in the wall prior to the mounting of the door frame so that concrete work may be done at one time. The door frame consists of packing rails, outer rails, link rails and seal strips. The outer rails are fitted on the packing rails which are secured to the wall and their connection is adjusted so that the outer rails are precisely perpendicular or level to the door frame. Link rails are provided to conceal the clearances formed between the wall and the outer rails and securing the outer rails to the packing rails. The seal strips are provided with ornamental surfaces for concealing the link rails. By means of the method of mounting the door frame according to the present invention, the drawbacks in the prior art are eliminated; the threshold is laid prior to mounting of the door frame so that the door frame may not be stained by concrete or caused to deform.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
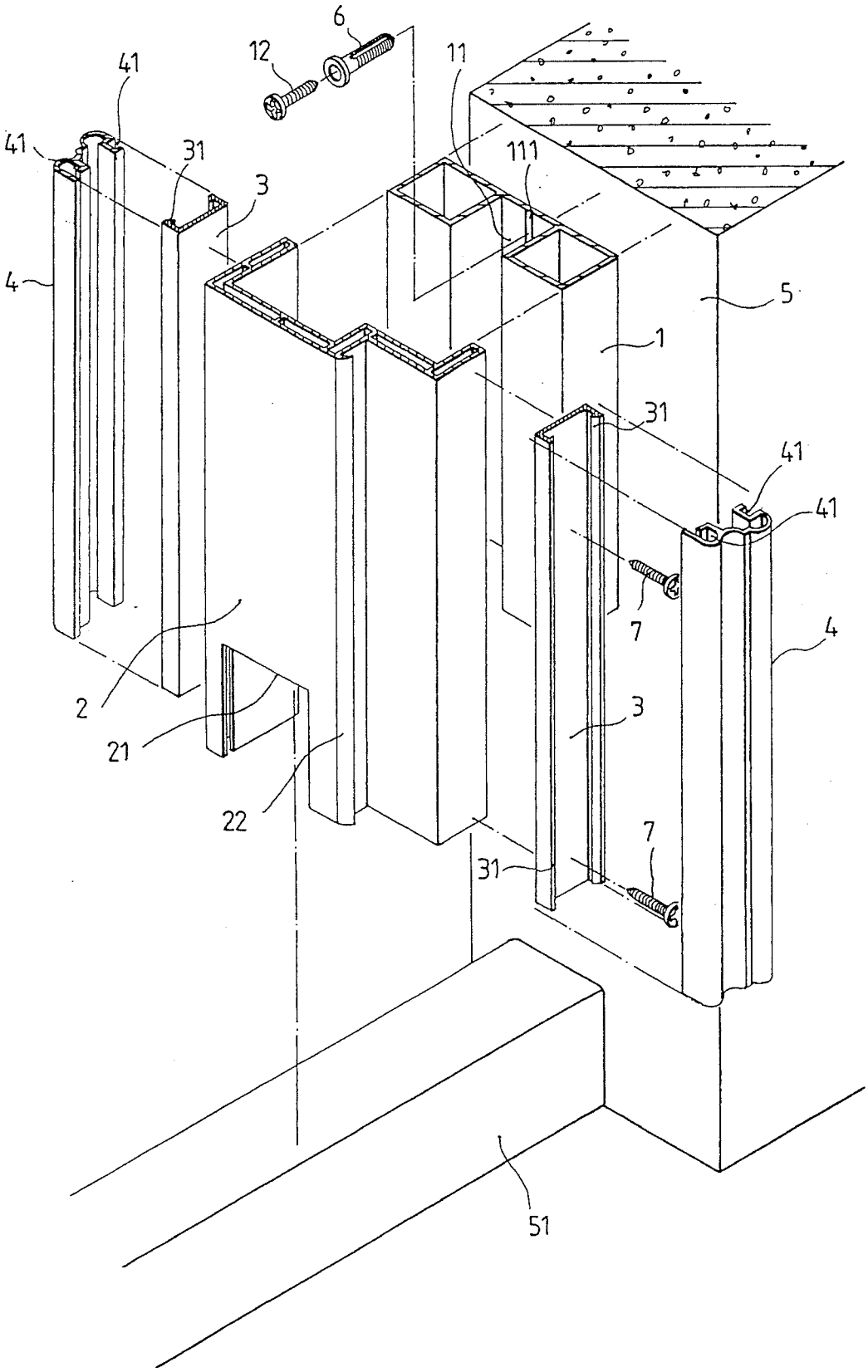
FIG. 1 is an exploded schematic view of the structural parts of the present invention.

With reference to FIG. 1, the plastic door frame according to the present invention comprises a plurality of packing rails 1, a plurality of outer rails 2, a plurality of link rails 3, and plurality of seal strips 4. These plastic structural parts are assembled together to form an integral door frame, and they are cut at 45 degrees at appropriate positions so that they may form an inverted-U shaped door frame with both lateral rails perpendicular to the top rail of the door frame. After construction work of a door hole in the wall and a threshold 51 are completed, the structural parts of the door frame may be mounted on the wall one by one. Any necessary repair work or trimming to be done on the door hole and the threshold 51 or painting of the walls may be completed before mounting of the door frame according to the present invention, and there is no need to repair or trim any defects in the wall after installation of the door frame as in the prior art. The structure of the parts of the door frame and method of mounting the same according to the present invention are described in detail hereinbelow.

Each packing rail 1 is a substantially hollow frame structure having a recess 11 provided in a middle portion thereof or at a pre-determined suitable position. The recess 11 may be provided with a longitudinally oriented groove 111 for penetration of screws 12 therethrough. The screws 12 may be driven into expansion sleeves 6 pre-planted in an inner wall of the door hole to achieve secure connection and positioning. It should be understood that there are various ways of locking the packing rail 1 to the inner wall 5 of the door hole, e.g., expansion screws may be used instead of expansion sleeves, and they are not discussed in detail herein.

Figure 2:
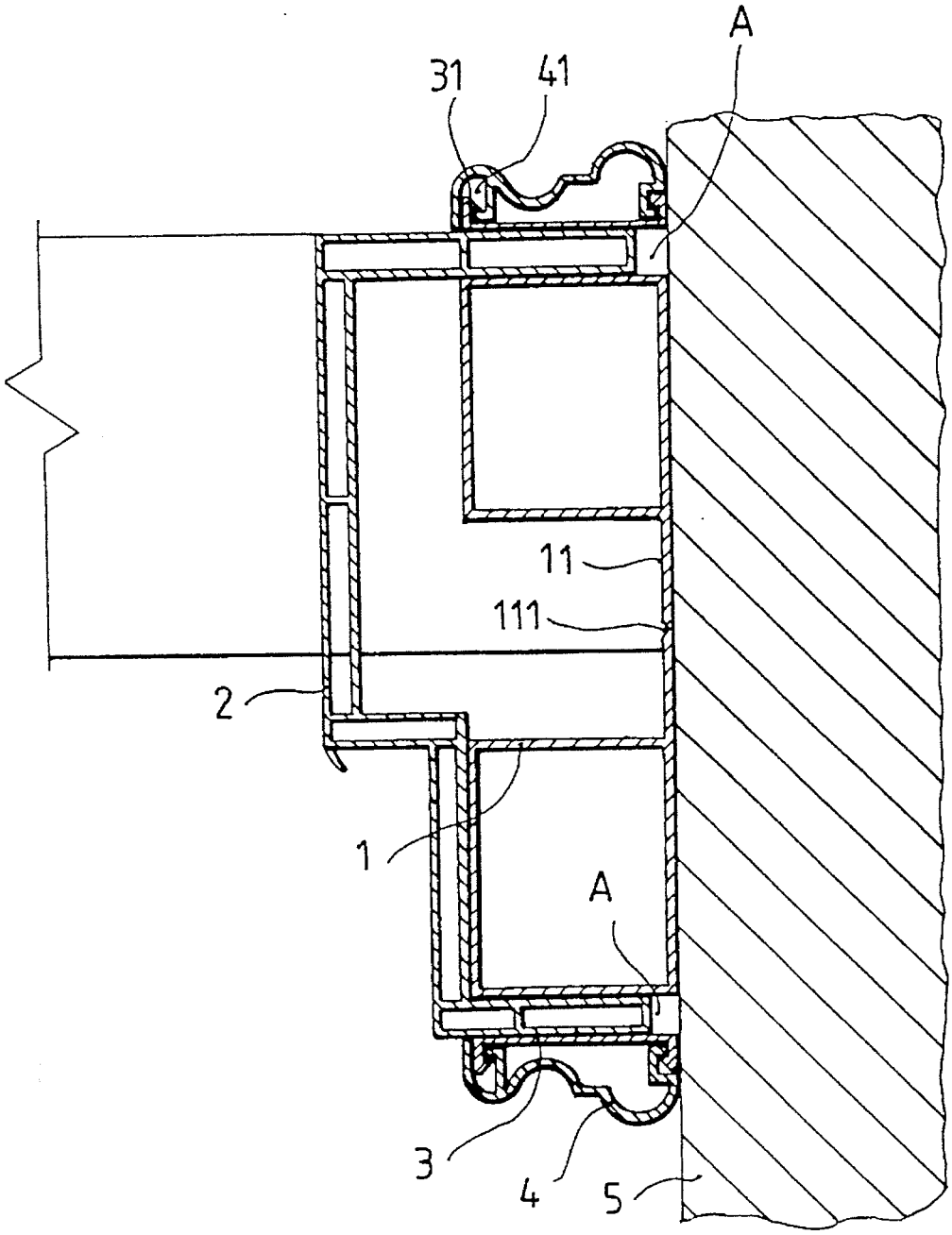
FIG. 2 is a sectional view of the structural parts of the present invention in an assembled state.
Figure 3:
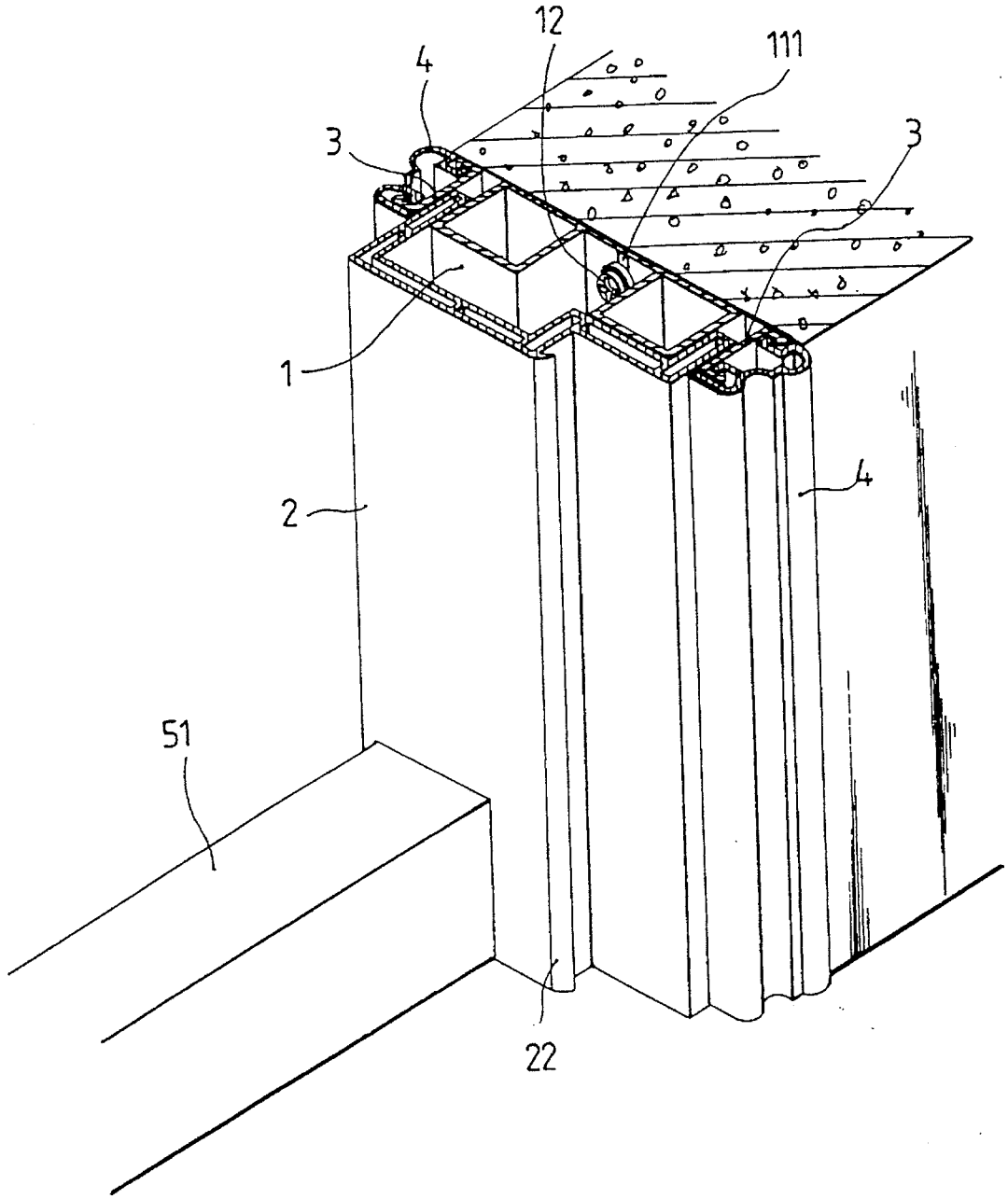
FIG. 3 is a perspective view of the assembled structural parts of the present invention with a partial cross section.
Figure 4:
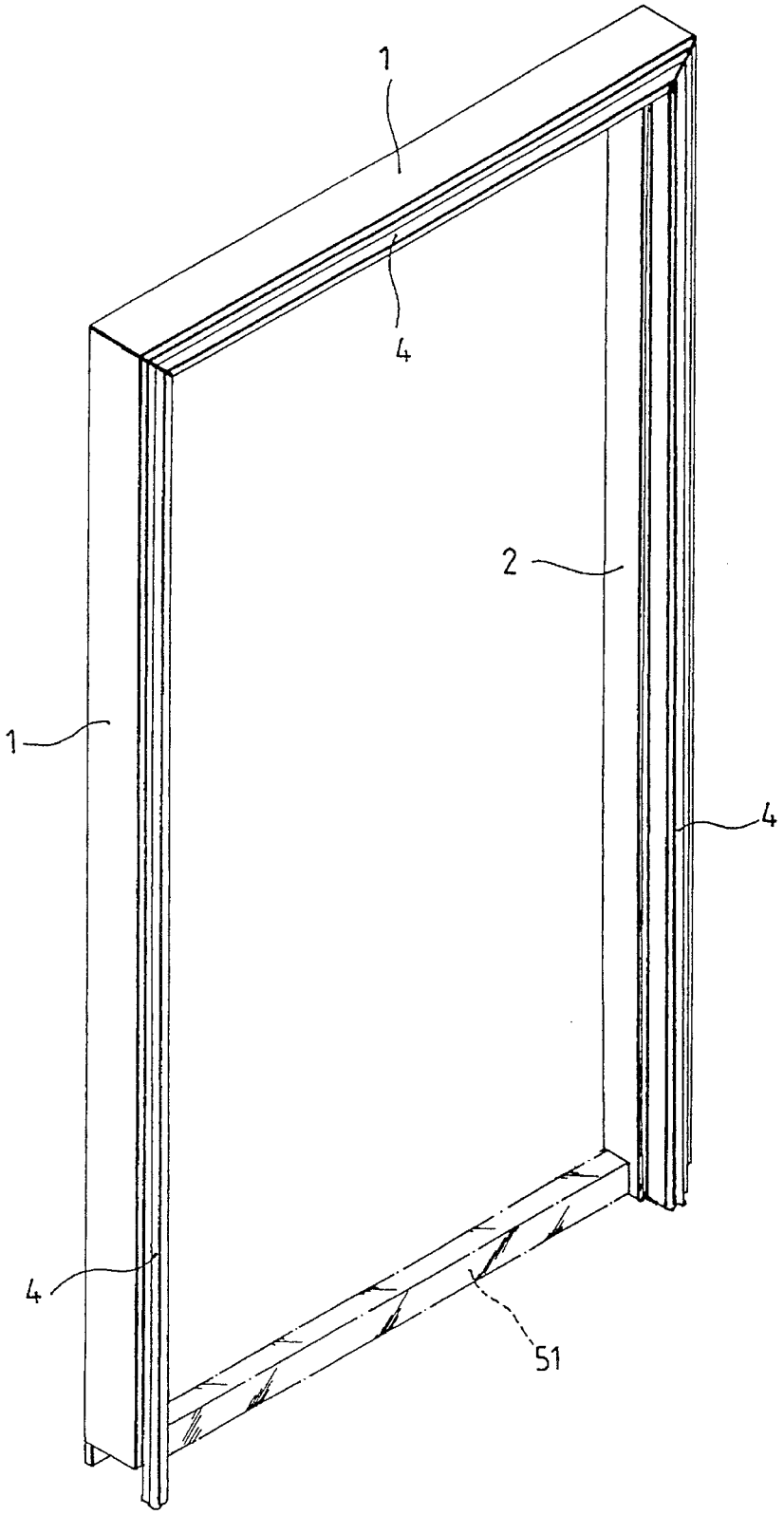
FIG. 4 is an outer perspective view of the door frame according to the present invention.

Each outer rail 2 is substantially a stepped hollow rail structure. An outer surface thereof has a baffle strip 22, and an inner surface thereof has an internal width equivalent to or slightly smaller than the external width of the packing rail 1, so that the outer rail 2 may fit onto the packing rail 1 (as shown in FIG. 2). By adjusting the extent the outer rail 2 is fitted onto the packing rail 1, precise horizontal or vertical position of the door frame may be obtained, so that after the outer rails 2 are fitted in place, a door frame with precise right angles may be achieved. The outer rails 2 at both lateral sides of the door hole are each provided with an opening 21 having a width corresponding to that of the threshold 51 so that the openings 21 of the outer rails 2 may fit perfectly onto the threshold 51.

Each link rail 3 is a substantially elongated rail structure having an inverted-U shaped cross section. The link rail 3 is also provided with a protruding hook strip 31 at either lateral side thereof for concealing a clearance A formed between each lateral side edge of the outer rail 2 and the inner wall 5 due to adjustment of the outer rail 2 on the packing rail 1. The link rail 3 is arranged properly against the outer rail 2 and the inner wall 5 so as to conceal the clearance A, and a plurality of locking elements, such as screws 7, may be driven through the link rail 3 and the outer rail 2 into a side wall of the packing rail 1, so that the outer rail 2 may be securely positioned and the clearance A is completely covered up.

Each seal strip 4 is provided with a retaining groove 41 at either lateral side thereof for receiving the hook strip 31 of the link rail 3. An outer surface of the seal strip 4 may be configured to have steps or curves or other ornamental shapes so that, after it is properly coupled to the link rail 3, it may form an ornamental strip and completely conceals the link rail 3.

Steps of mounting the door frame comprising the above-described parts will be described hereinbelow:

(1) laying the threshold at a suitable position of the door hole;

(2) securing the packing rails onto the inner walls of the door hole by screws or other suitable locking elements;

(3) fitting the outer rails onto the corresponding packing rails and adjusting the depth of the outer rails on the packing rails so that the outer rails may be horizontally or vertically oriented in a precise manner, and the openings at the lower ends of the outer rails disposed at the lateral sides of the door hole may fit perfectly onto the threshold;

(4) arranging the link rails on both lateral sides of each outer rail such that they conceal the clearance formed between the inner wall and the outer rail, and driving securing elements through the link rail and the outer rail into the packing rail so that each outer rail is firmly locked and positioned;

(5) fitting the seal strips onto the link rails such that the hook strips at both lateral sides of each link rail are received in the retaining grooves at both lateral sides of each seal strip; and (6) cutting the ends of the corresponding parts of the door frame according to the present invention at 45 degrees so that they may together form an inverted-U shaped frame structure with both side frames perpendicular to the top frame.

As the step of cutting the ends of the assembled parts of the door frame according to the present invention at 45 degrees is known in the art, it is not described in detail herein.

In the present invention, there is no need to provide metal sheets or plates at the rear side of the door frame to secure it to the wall as in the conventional method. Mounting of the door frame may be proceeded after the threshold is installed and the walls are plastered or painted, without the disadvantages in the conventional method in which the door frames are or may be marred by concrete or plaster or even caused to deform in shape. The present invention provides a clean and simple way of mounting a door frame at less cost and labor. If desired, cracks such as those between the packing rails and the wall or the threshold may be filled with silicon gel for sealing purposes.

Although the present invention has been illustrated and described with reference to the preferred embodiment thereof, it should be understood that it is in no way limited to the details of such embodiment but is capable of numerous modifications within the scope of the appended claims.

What is claimed is:

1. A plastic door frame assembly comprising:

a) a plurality of packing rails, each packing rail being of a hollow rail configuration for attachment onto an inner wall of a door opening;

b) a plurality of outer rails, each outer rail being of a hollow rail configuration with a stepped outer surface and includes a pair of lateral side walls, a baffle strip on the outer surface, an internal dimension substantially equivalent to the external dimension of the packing rail for fitting onto the packing rail and permitting adjusting the position of the outer rail with respect to the packing rail to create a clearance between each lateral side of the outer rail and the inner wall of the door opening, and each of two outer rails including an opening for fitting onto a threshold;

c) a plurality of elongate link rails, each link rail having a U-shaped transverse cross-section defined by a base wall for attachment to a lateral side wall of the outer rail and abut the inner wall to conceal the clearance formed between the lateral side wall of the outer rail and inner wall of the door opening, and a pair of side walls, each side wall terminating in a hook strip; and d) a plurality of elongate seal strips, each seal strip including a pair of lateral sides, each lateral side having a retaining groove for engaging a hook strip of a link rail to secure the seal strip to and conceal the link rail.

2. The door frame assembly of claim 1 wherein each packing rail further includes a recess formed along a middle portion thereof, a longitudinal groove formed in a wall of the recess for receiving fasteners to secure the packing rail to the inner wall of the door opening.

3. A method of mounting a plastic door frame assembly in a door opening defined by a top inner wall, a pair of opposed side inner walls and an installed threshold, the method comprising the steps of:

a) securing a packing rail onto each inner wall;

b) fitting an outer rail having a pair of opposed lateral sides onto each packing rail and positioning the outer rail horizontally or vertically on the packing rail to establish a clearance between each lateral side and the inner wall;

c) securing a link rail on each lateral side on each outer rail to abut the inner wall and conceal the clearance formed between the lateral side and the inner wall; and d) fitting a seal strip onto each link rail.

4. The method of claim 3 further including the steps of:

a) providing each outer rail of each side inner wall with an opening at a lower end thereof and fitting the opening onto the installed threshold; and b) cutting the adjacent end portions of the packing rails, outer rails, link rails and seal strips at the corners defined by the top inner wall and the side inner walls at forty-five degrees to form an inverted U-shaped frame assembly.

* * * * *